United States Patent [19]

Adam

[11] Patent Number: 4,647,321

[45] Date of Patent: Mar. 3, 1987

[54] DISPERSION STRENGTHENED ALUMINUM ALLOYS

[75] Inventor: Colin M. Adam, Tequesta, Fla.

[73] Assignee: United Technologies Corporation, Hartford, Conn.

[21] Appl. No.: 540,712

[22] Filed: Oct. 13, 1983

Related U.S. Application Data

[63] Continuation of Ser. No. 209,568, Nov. 24, 1980, abandoned.

[51] Int. Cl.[4] ..... C22B 21/00; B29B 9/00; B22F 1/00; C22C 21/00

[52] U.S. Cl. ..... 148/415; 148/405; 75/249; 420/550; 419/33; 419/41; 419/67; 264/6; 264/8

[58] Field of Search ..... 148/11.5 A, 405, 415; 428/568; 75/138, 249; 420/550; 419/33, 41, 67; 264/5 C, 6, 8

[56] References Cited

U.S. PATENT DOCUMENTS

| | | | |
|---|---|---|---|
| 1,579,481 | 4/1926 | Hybinette | 420/550 |
| 1,675,708 | 7/1928 | Hybinette | 420/550 |
| 2,963,570 | 3/1961 | Wachtman | 75/249 |
| 2,963,780 | 12/1960 | Lyle, Jr. et al. | 75/249 |
| 2,967,351 | 1/1961 | Roberts et al. | 75/211 |
| 2,967,531 | 1/1961 | Roberts et al. | 75/211 |
| 3,147,110 | 9/1964 | Foerster | 75/249 |
| 3,625,677 | 12/1971 | Jones | 75/138 |
| 3,899,820 | 8/1975 | Read et al. | 29/420.5 |
| 4,025,249 | 5/1977 | King | 425/8 |
| 4,053,264 | 10/1977 | King | 425/8 |
| 4,069,045 | 1/1978 | Lundgren | 75/251 |
| 4,078,873 | 3/1978 | Holiday et al. | 425/8 |
| 4,259,270 | 3/1981 | Winter et al. | 268/4 |
| 4,265,676 | 5/1981 | Wes et al. | 148/11.5 A |
| 4,313,759 | 2/1982 | Raybould | 75/249 |
| 4,347,076 | 8/1982 | Ray et al. | 75/0.5 R |

OTHER PUBLICATIONS

Cox et al, Application of Rapidly Solidified Alloys, Quarterly Report, 1 Feb., 79–1 May 79, Contract #F33615-76-C-5136, Jun. 1979.

Rostoker et al, Fast Freezing by Atomization for Aluminum Alloy Development, Int. J. of Powder Metallurgy, 9(4) 1983, pp. 139–148.

Bryukhovets, Structures & Properties of Al-Cr & Al-Fe Alloys Prepared by the Atomization Technique, Poroshkovaya Metallurgiya, 1 (85) pp. 108–111, 1970.

Dobatkin et al, On Aluminium Alloys with Refractory Elements, Obtained by Granulation, Soviet Powder Metallurgy and Metal Ceramics, Aug. 1966, pp. 89–93.

Adam et al, Transition & Refractory Element Addition to Rapidly Solidified Aluminium Alloys, Second Conference on Rapid Solidification Processing, 23 Mar. 1980.

*Primary Examiner*—Gary P. Straub

*Attorney, Agent, or Firm*—Charles E. Sohl

[57] ABSTRACT

Aluminum alloy compositions and related fabrication techniques are described. Articles made of the composition by the process contain a novel dispersed strengthening phase based on iron and refractory metals. Rapid solidification techniques are used to assure a fine distribution of this phase. Articles made according to the invention have mechanical properties significantly in excess of those of conventional aluminum alloys.

6 Claims, 4 Drawing Figures

1000 A°

DISPERSION STRENGTHENED ALUMINUM ALLOYS

The Government has rights in this invention pursuant to Contract No. F33615-76-C-5136 awarded by the Department of the Air Force.

This is a continuation application of U.S. Ser. No. 209,568, now bandoned, filed Nov. 24, 1980 for DISPERSION STRENGTHENED ALUMINUM ALLOYS.

DESCRIPTION

1. Technical Field

This invention relates to aluminum alloys processed by powder metallurgy techniques which can be used to form articles which have useful mechanical properties at elevated temperatures, at least up to 350° C.

2. Background Art

Attempts have been made in the prior art to provide improved aluminum alloys by powder metallurgy techniques. These techniques have employed increased solidification rates over those rates generally obtained in conventional casting. However, the solidification rates obtained have not been sufficiently great to produce useful metastable phases in the limited number of alloy systems which have been studied.

The following journal articles deal with rapid solidification processing of aluminum alloys:

"Exchange of Experience and Information, Structures and Properties of Al-Cr and Al-Fe Alloys Prepared by the Atomization Technique". A. A. Bryukhovets, N. N. Barbashin, M. G. Stepanova, and I. N. Fridlyander. Moscow Aviation Technology Institute. Translated from Poroshkovaya Metallurgiya, No. 1 (85), pp. 108–111, January 1970.

"On Aluminum Alloys with Refractory Elements, Obtained by Granulation" by V. I. Dobatkin and V. I. Elagin. Sov. J. NonFerrous Metals Aug. 1966, pp 89–93.

"Fast Freezing by Atomization for Aluminum Alloy Development" by W. Rostoker, R. P. Dudek, C. Freda and R. E. russell. International Journal of Powder Metallurgy. pp 139–148.

U.S. Pat. Nos. 4,002,502, 4,127,426, 4,139,400 and 4,193,822 all relate to aluminum alloys containing iron as a major alloy ingredient. U.S. Pat. No. 4,127,426 also describes the rapid solidification of an alloy containing up to 5% iron.

DISCLOSURE OF INVENTION

It is a major object of this invention to provide aluminum alloy articles having useful mechanical properties at temperatures up to at least 350° C.

It is another object of this invention to describe a class of aluminum alloys which may be processed by powder metallurgy techniques to provide high strength articles.

Yet another object of this invention is the description of powder metallurgy processes which may be employed with a class of aluminum alloys to provide articles with exceptional mechanical properties at elevated temperatures.

This invention concerns a new class of aluminum alloys which are strengthened by a novel precipitate. Precipitation strengthened aluminum alloys are known in the prior art. Such alloys are typified by the alloys based on the aluminum-copper system (such as 2024). In such a classic precipitation hardening system advantage is taken of decreasing solid solubility of one element in another so that a controlled precipitate can be produced by a thermal treatment. In the case of the aluminumcopper system the decreasing solid solubility of copper and aluminum makes possible the development and control of precipitate particles based on $CuAl_2$. Since the solid solubility of copper and aluminum increases with temperature, such materials have only limited capability to resist stresses at elevated temperatures since the precipitate phase tends to dissolve at elevated temperatures. Another class of alloys which is strengthened by particles are those known as SAP alloys. SAP alloy articles are produced by powder metallurgy techniques in which aluminum alloy powder is oxidized and then compacted and severely cold worked. The result of this treatment is the development of a structure containing fine discrete particles of aluminum oxide. Since aluminum oxide is essentially insoluble in aluminum, this class of alloys is more stable at elevated temperatures than are the precipitation alloys formed by a true precipitation phenomenon.

The present invention concerns a class of alloys which in some respects combines the advantages of both types of materials previously described. The invention aluminum alloys are strengthened by a precipitate based on iron and one or more refractory elements. Both iron and the refractory elements have an extremely small solid solubility in aluminum and for most practical purposes may be said to be insoluble in aluminum. As a consequence precipitate particles based on iron and the refractory elements are quite stable in aluminum even at elevated temperatures. The alloys are prepared by a process which includes rapid solidification from the melt at rates which preferably exceed $10^{5°}$ C. per second. This rapid solidification rate ensures that the precipitate particles, which form upon solidification from the melt, are fine and uniformly dispersed. The short time involved in the solidification does not permit significant particle growth. If the solidification rate is sufficiently high, formation of amorphous or non crystalline regions rich in iron and the refractory elements will result. This is a preferred result since these amorphous regions can be controllably decomposed through thermal treatment to provide an exceptionally fine dispersion of precipitate particles.

Any cooling rate which exceeds about $10^{5°}$ C. per second will provide iron-refractory metal compounds which have a non equilibrium metastable structure. In the extreme case the structure will be amorphous while at lower cooling rates a series of different non equilibrium crystalline precipitate structures will occur. It is believed that the precipitates transform through these different structures towards the equilibrium structure during exposure at elevated temperatures.

The aluminum alloy powder so produced is compacted to form a bulk article. A variety of compacting techniques can be used so long as the alloy temperature does not rise significantly above about 350° C. for any significant length of time.

Other features and advantages will be apparent from the specification and claims and from the accompanying drawings which illustrate an embodiment of the invention.

BEST MODE FOR CARRYING OUT THE INVENTION

Figure 1:
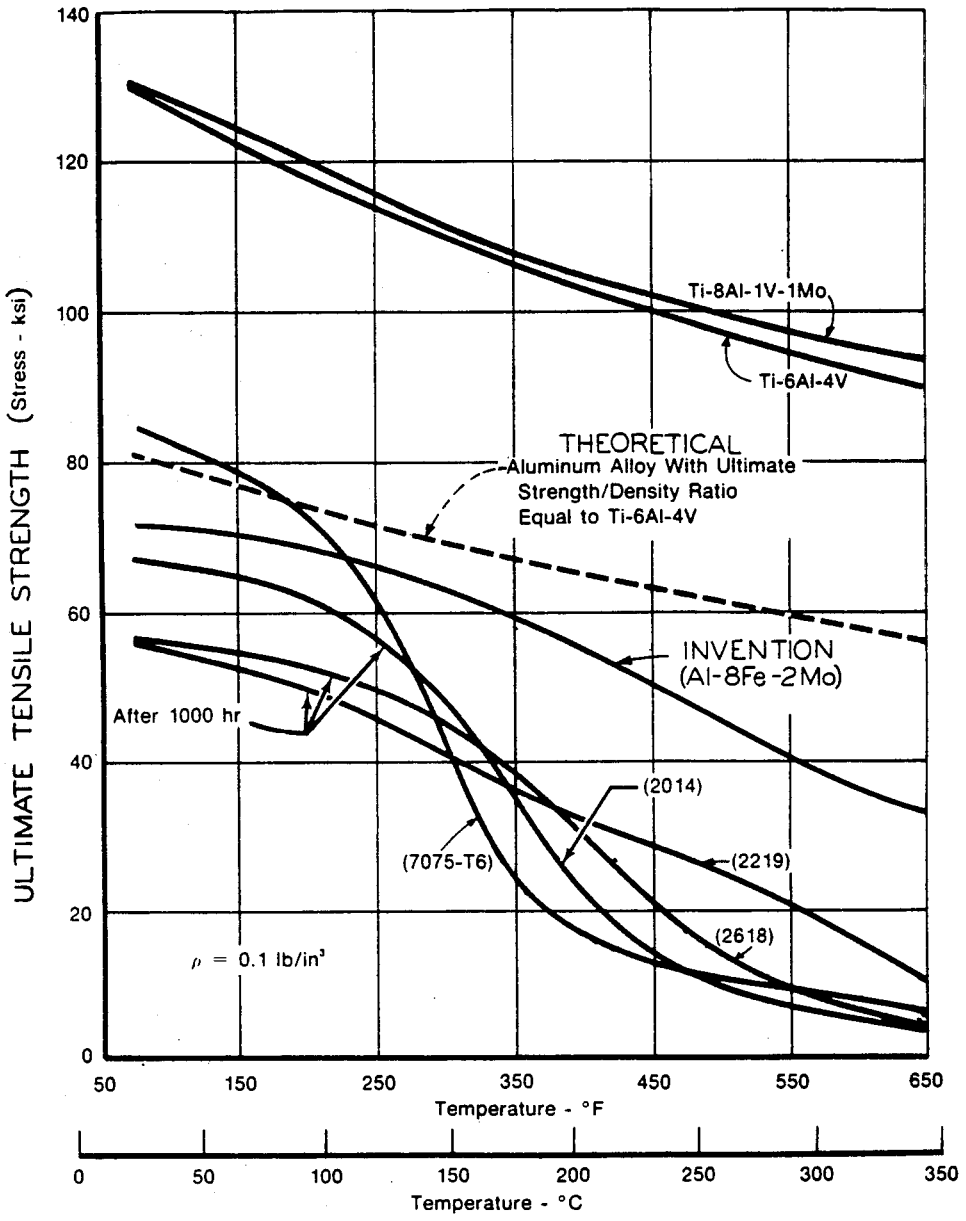
FIG. 1 shows the ultimate tensile strength as a function of temperature of several conventional aluminum and titanium alloys and an alloy of the present invention.

Turning now to the specifics of the invention, the alloys are based on aluminum and contain from 5 to 15% iron by weight and from 1 to 5% by weight of at least one refractory metal selected from the group consisting of niobium, zirconium, hafnium, titanium, molybdenum, chromium, tungsten and vanadium and mixtures thereof. Preferably the refractory metal is present in an amount of from 15 to 35% of the iron content. These refractory elements combine with iron to form a strengthening precipitate phase based on $Al_3Fe$ with the refractory metal partially substituting for some of the iron.

I believe that my invention is in large measure a discovery of this novel useful strengthening phase and I am aware that many other elements could be added to this alloy for a variety of purposes including improved solid solution strengthening and improved corrosion resistance without materially affecting the strengthening affect which is obtained from the novel precipitate of the invention. I therefore broadly describe my invention as being an aluminum solid solution matrix which may contain up to 5% by weight of a solid solution strengthening element, which also contains from about 5 to about 30 volume percent of a strengthening precipitate based on iron and at least one of the aforementioned refractory metals. These strengthening particles have an average diameter of less than 500 angstroms and preferably less than 300 angstroms and are typically spaced less than 2000 angstroms apart.

Such a structure can to my knowledge only be obtained through a high rate solidification. To obtain such a structure it is necessary to provide the alloy in a melted excess of $10^{5°}$ C. per second. If the iron and refractory metal contents are increased, a higher cooling rate will be necessary to achieve the same non equilibrium structure. While there are several techniques known which can produce such rapid solidification rates, these techniques are mainly suited for laboratory production of small quantities of material. The technique which I prefer to use to produce commercial quantities of this material is known as the RSR technique. This technique employs a horizontally disposed disk which is spun at a rate of about 20,000–30,000 rpm while the material to be atomized is poured on a disk. The spinning disk throws the liquid material off where upon it is cooled by jets of helium gas. The process is described in U.S. Pat. Nos. 4,025,249, 4,053,264 and 4,078,873 which are incorporated herein by reference. While this is the preferred process, what is important is the cooling rate rather than the specifics of the process used to obtain the cooling rate. Another advantage of the preferred process is the cleanness of the powder which is produced. Aluminum is a reactive element and it is desirable that oxidation of the powder be minimized or avoided. This requires a clean processing apparatus and the previously described process satisfied these needs.

Having produced the material in a particulate form the material is then compacted to form an article of useful dimensions. Such compaction may be performed using a variety of processes known to those skilled in the metallurgical arts. A necessary condition however, is that the material not be exposed to temperatures significantly in excess of 350° C. for any significant period of time. Exposures to temperatures in excess of about 350° C. will result in an undesirable amount of coarsening of the strengthening precipitates and a reduction in mechanical properties. Compaction techniques which have been successfully employed include extrusion at temperatures of about 300° C. Another compaction technique which appears practical is dynamic compaction using a shock wave to bond the powder particles together without inducing significant temperature rise.

As previously indicated this class of alloys can display a range of precipitate structures varying from amorphous to the equilibrium crystal structure. If extremely high solidification rates have been employed so that a substantial amount of the amorphous phase is present, it may be desirable to controllably transform this phase into another more stable crystalline phase prior to placing the article in service. This may readily be obtained by heat treating the compacted article at a temperature between about 50° and 300° C. for a period of time sufficient to cause a desired transformation.

Figure 2:
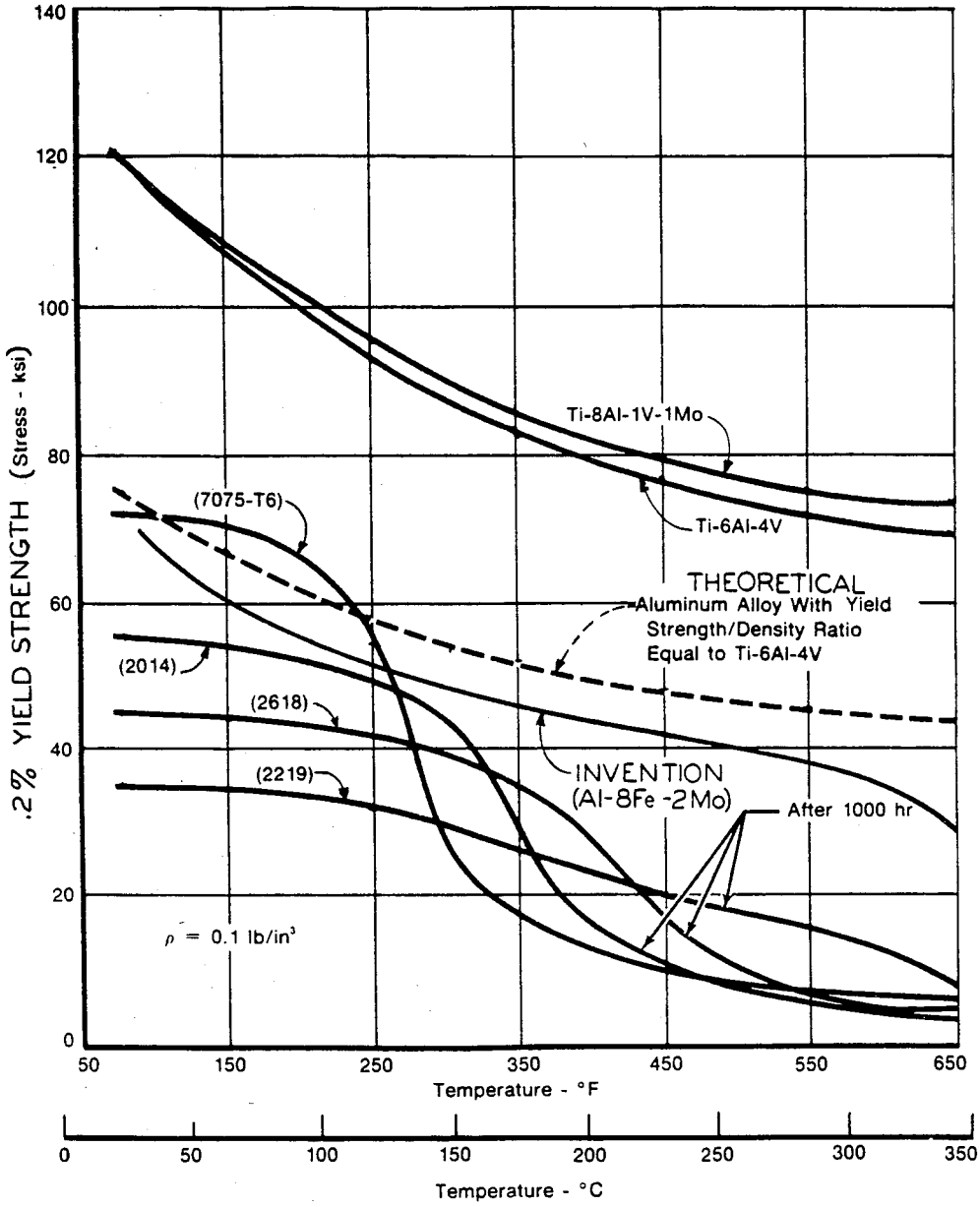
FIG. 2 shows the yield strength as a function of temperature for several conventional aluminum and titanium alloys and an alloy of the present invention.
Figure 3:
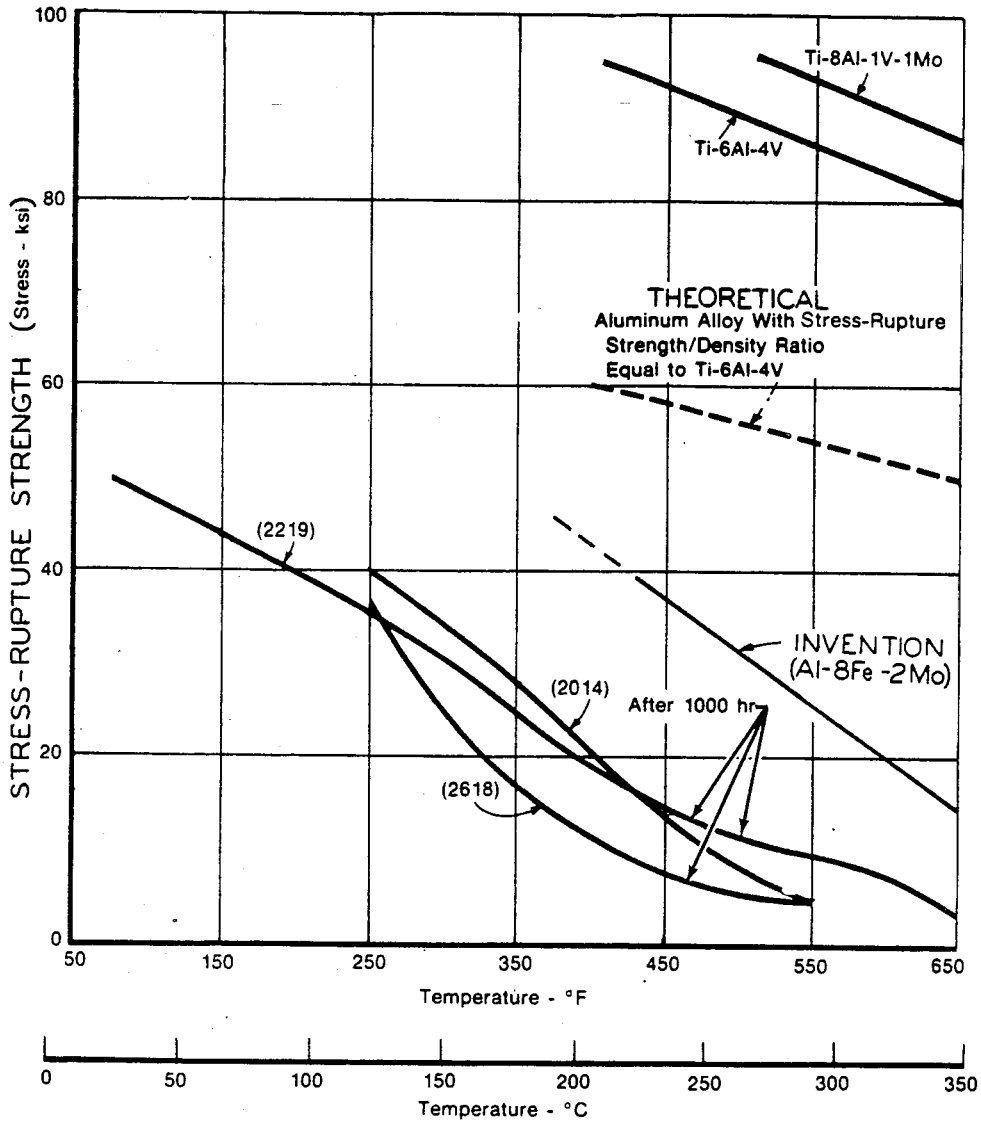
FIG. 3 shows stress rupture properties as a function of temperature for several conventional aluminum and titanium alloys and an alloy of the present invention.

The previously described features of the present invention may be better understood through reference to the figures. FIGS. 1, 2 and 3 illustrate the mechanical properties of one specific composition processed according to the present invention compared with several existing high strength aluminum alloys and two common titanium alloys. The compositions of the aluminum alloys are shown in Table 1 below.

TABLE 1

| | |
|---|---|
| 2014 | 4.4% Cu, .8% Si, .8% Mn, .4% Mg |
| 2219 | 6.3% Cu, .3% Mn, .1% V, .15% Zr |
| 2618 | 2.3% Cu, 1.6% Mg, 1.0% Ni, 1.1% Fe |
| 7075 | 5.6% Zn, 1.6% Cu, 2.5% Mg, .3% Cr |

Such titanium and aluminum alloys are commonly used in applications where high strength and low density are required. Titanium alloys are in general stronger and maintain their strength at higher temperatures than do aluminum alloys. However titanium is much more expensive than aluminum and there is consequently a great need for higher strength aluminum alloys, especially those which can maintain their strength at elevated temperatures. Alloys of the present invention bridge the gap in properties between conventional aluminum alloys and titanium alloys.

For application in rotating machinery where the stresses imposed on a component are largely the result of centrifugal force acting on the component, it is not the absolute strength which is of importance so much as the ratio of strength to density. Obviously a high density article will generate greater internal stresses than an identical article of lesser density. Titanium alloys are somewhat more dense than aluminum alloys. FIGS. 1, 2 and 3 each contain a dotted line which represents a theoretical alloy with the strength/density ratio of a common titanium (Ti-6Al-4V) alloy combined with the density of a typical aluminum alloy. If an aluminum alloy could be developed which equaled or exceeded the properties designated by the dotted line, such an alloy would be equivalent to titanium in many respects for high performance applications, especially in rotating machinery.

One invention alloy composition was prepared and from this specific alloy certain mechanical properties determined. The alloy was a simple one containing 8 weight percent iron, 2 weight percent molybdenum balance aluminum and was prepared using the previously described rapid solidification rate process with a cooling rate in excess of about $10^{6}$° C. per second. The result of this cooling process was a powder material which was compacted and hot extruded to produce a material from which test samples were machined.

With reference now to FIG. 1, the ultimate tensile strength as a function of temperature of several conventional aluminum and titanium alloys are shown. Also shown is a curve illustrating the properties of the previously described Al-8% Fe-2% Mo alloy as well as a dotted line showing the ultimate tensile strength of a theoretical alloy having the same strength/density ratio as Ti-6%Al-4%V and the density of aluminum. An aluminum alloy with this combination of strength and density could be directly substituted for Ti-6Al-4V in rotating machinery applications. It can be seen that in terms of ultimate strength at elevated temperatures the invention alloy is substantially superior to the conventional high strength aluminum alloys. From temperatures of 100° C. upwards the invention alloy is stronger than the prior art aluminum alloys. At elevated temperatures such as 290° C. the superiority of the invention alloy is notable, since at 290° C. the strongest conventional aluminum alloy had an ultimate tensile strength of about 20 ksi whereas the invention alloy has double that strength, 40 ksi. By way of comparison the theoretical aluminum alloy with the strength to density ratio of titanium would have an ultimate tensile strength of 60 ksi. Thus in terms of ultimate tensile strength as a function of temperature, the invention alloy bridges the gap between conventional alloys and titanium alloys.

FIG. 2 shows a similar comparison of strength versus temperature except that the strength parameter shown is yield strength measured at 0.2% offset). Again curves are shown for conventional high strength aluminum and titanium alloys and a dotted line shows the yield strength of an alloy having the yield strength to density ratio of Ti-6Al-4V. In terms of yield strength the invention alloy (Al-8Fe-2Mo) is very near the theoretical alloy and is markedly superior to the conventional high strength aluminum alloys. A significant feature which is evident in FIG. 2 is that the conventional high strength aluminum alloys all have a significant drop in yield strength in the temperature range of about 125° C. and about 250° C. The invention alloy does not show a sharp decrease in yield strength until a temperature approaching 350° C. This is an increase of about 100° C. in useful operating temperatures and this is a significant advantage of the material of the present invention. The increased softening temperature of the present alloy is indicative of greater alloy stability.

FIG. 3 shows stress rupture properties of various high strength aluminum and titanium alloys as a function of temperature. Again, the properties of a theoretical aluminum alloy with the strength to density ratio of Ti-6% 1-4%V are also shown. The curves shown indicate the stress required at a given temperature to produce failure in a sample after 1000 hours of exposure. Again the invention alloy is shown to be superior to the conventional high strength aluminum alloys.

Figure 4:
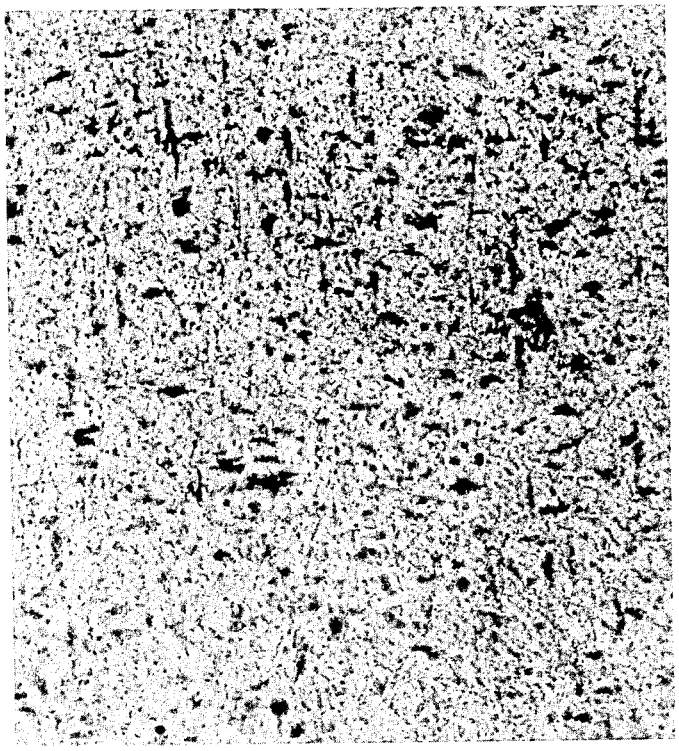
FIG. 4 shows a photomicrograph of an alloy of the present invention after exposure at an elevated temperature.

FIG. 4 is a transmission electron micrograph of the previously described aluminum - 8Fe-2Mo material after exposure at 290° C. for 4 hours. The significant feature seen in the photomicrograph is that the precipitate phase is extremely fine even after exposure for temperatures and times which would produce substantial softening in all conventional aluminum alloys. The precipitate structure is generally seen to be on the order of 100 angstroms in size after this treatment.

The invention alloys also have higher moduli of elasticity than do conventional aluminum alloys. The modulus of elasticity relates to the stiffness of the alloy and high modulus values are desired for structural applications. Conventional aluminum alloys have modulus values of about $10\times10^{6}$ psi and conventional titanium alloys have modulus values of 14–16 $\times$ $^{6}$ psi. The measured value for modulus for the previous described Al-8%Fe-2% Mo alloy is $12.4\times10^{6}$ psi. The range of modulus values for the invention alloys will be from $12–16\times10^{6}$ psi.

It should be understood that the invention is not limited to the particular embodiments shown and described herein, but that various changes and modifications may be made without departing from the spirit and scope of this novel concept as defined by the following claims.

I claim:

1. A high strength aluminum alloy article consisting essentially of about 5 to 15 weight percent iron, about 1 to 5 weight percent molybdenum, alone or in combination with an element selected from the group consisting of vanadium, titanium, zirconium, hafnium, niobium, tungsten, chromium and mixtures thereof, balance aluminum, said article having a microstructure which comprises an aluminum solid solution matrix containing a dispersion of strengthening particles, said particles being based on the compound $Al_3Fe$ with a portion of the Fe content being replaced with said molybdenum, and said element selected from the group consisting of vanadium, titanium, zirconium, hafnium, niobium, tunsten, chromium where present, said particles having an average size of less than 500 angstroms and an average spacing of less than 2,000 angstroms.

2. An aluminum alloy article as in claim 1 in which the average particle size is less than 300 angstroms.

3. An article according to claim 1 which exhibits an ultimate tensile strength of about 40 ksi at a temperature of about 290° C.

4. A method for producing a high strength aluminum alloy article including the steps of:

a. solidifying aluminum alloy which consists essentially of 5 to 15 weight percent iron and 1 to 5 weight percent of a mixture of molybdenum and vanadium balance aluminum, at a rate in excess of about $10^{5}$° C./sec. to form a solid particulate;

b. consolidating the particulate into a unitary mass at a temperature below about 350° C.

5. A method for producing aluminum alloy particulate material includintg the steps of:

a. preparing a melt of an aluminum alloy which consists essentially of 5 to 15 weight percent iron and 1 to 5 weight percent of molybdenum, balance aluminum;

b. flowing the molten alloy onto a horizontally disposed spinning disk atomizer means which flings the molten metal outwardly through an annular curtain of flowing cooling fluid, said material being formed directly into particulate form from the liquid state and being cooled at a rate in excess of about $10^{5°}$ C./sec.

6. A method for producing an aluminum article having high strength at elevated temperatures including the steps of:

a. preparing a melt of an aluminum alloy whicch consists essentially of 5 to 15 weight percent iron and 1 to 5 weight percent molybdenum balance aluminum;

b. flowing the molten alloy onto a horizontally disposed spinning disk atomizer means which flings the molten metal outwardly through an annular curtain of flowing cooling fluid, said material being formed directly into particulate form from the liquid state and being cooled at a rate in excess of about $10^{5°}$ C./sec.;

c. consolidating said paritculate into a Unitary mass at a temperature below about 350° C.

* * * * *